US007022055B2

(12) United States Patent
Toal

(10) Patent No.: US 7,022,055 B2
(45) Date of Patent: Apr. 4, 2006

(54) PHYSICAL INTERACTION MEANS AND RELATED USES THEREOF

(75) Inventor: Christopher Charles Toal, Auckland (NZ)

(73) Assignee: Bodywall Limited, Auckland (NZ)

( * ) Notice: Subject to any disclaimer, the term of this patent is extended or adjusted under 35 U.S.C. 154(b) by 62 days.

(21) Appl. No.: 10/367,996

(22) Filed: Feb. 19, 2003

(65) Prior Publication Data

US 2003/0224916 A1 Dec. 4, 2003

(30) Foreign Application Priority Data

Mar. 12, 2002 (NZ) ..... 517750

(51) Int. Cl.
*A63B 71/00* (2006.01)

(52) U.S. Cl. ..... 482/148; 482/37; 248/925

(58) Field of Classification Search ..... 482/148, 482/44–50; 2/159; D02/617
See application file for complete search history.

(56) References Cited

U.S. PATENT DOCUMENTS 3,099,884 A * 8/1963 Kixmiller et al. ..... 36/101
4,457,510 A * 7/1984 Pertschuk ..... 482/140
5,079,776 A * 1/1992 Crawford ..... 2/20
6,279,164 B1 * 8/2001 Martin ..... 2/161.1

* cited by examiner

*Primary Examiner*—Gregory L. Huson
*Assistant Examiner*—L. Amerson
(74) *Attorney, Agent, or Firm*—Jacobson Holman PLLC

(57) ABSTRACT

A physical interaction device which includes a wall and a floor presenting a surface of a hook or loop component of a hook and loop fastening system. Also provided is at least one glove and at least one piece of footwear which includes an outer surface presenting the other hook or loop component of the hook and loop fastening system. Each of the glove and piece of footwear can be selectively and releasably attachable by a person wearing such, to the surface of the wall and floor to thereby immobilize the hand or foot and allow the person to apply an action force countered by the wall or floor in a reactionary manner.

12 Claims, 10 Drawing Sheets

FIGURE 1
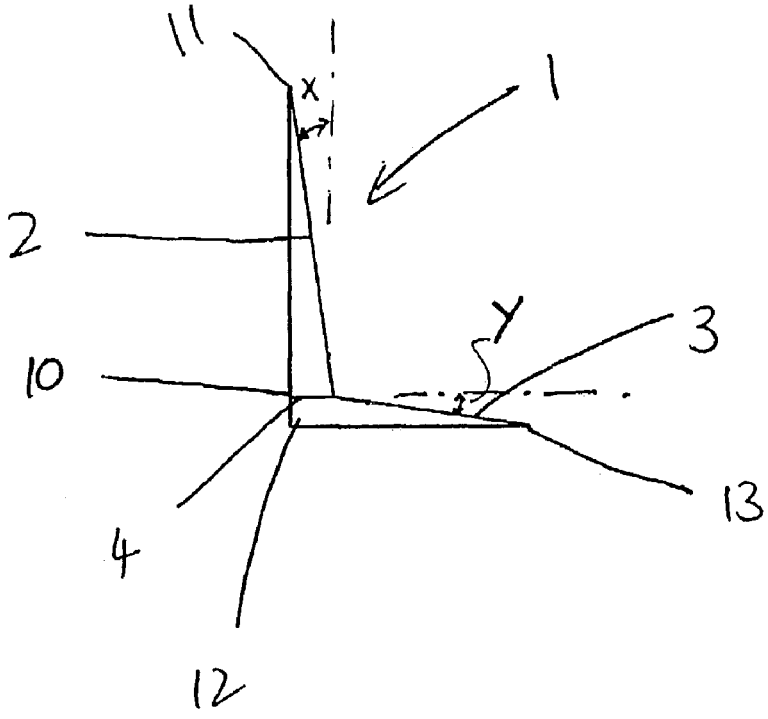
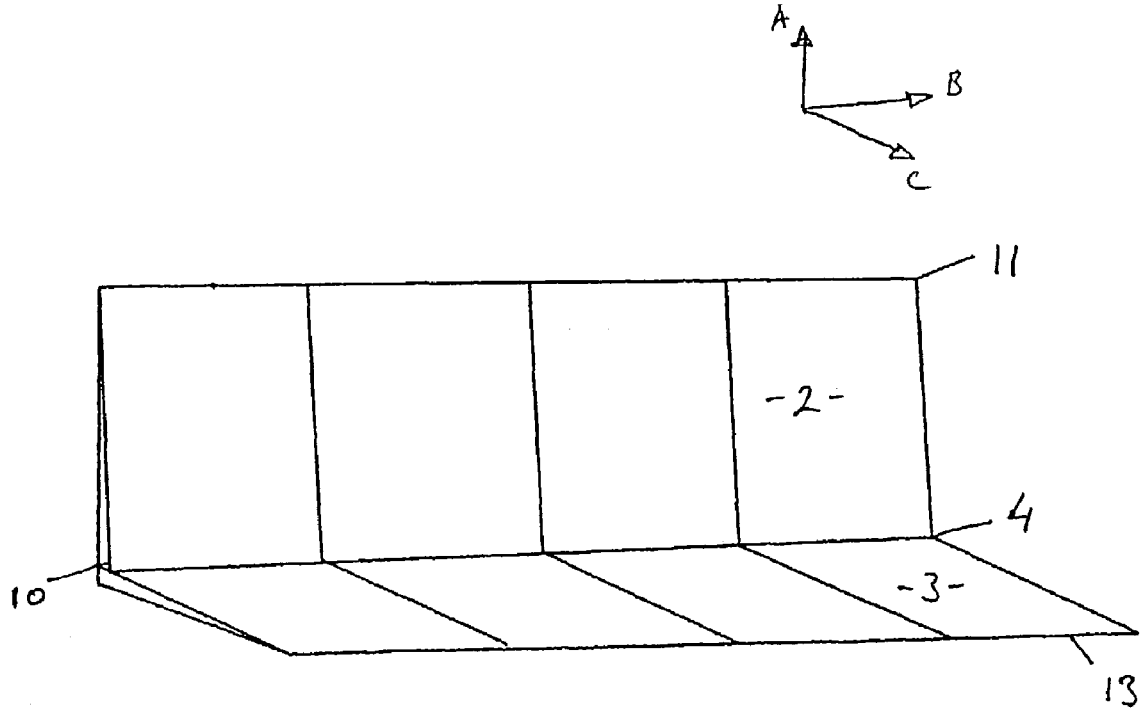
Fig 2

PHYSICAL INTERACTION MEANS AND RELATED USES THEREOF

FIELD OF INVENTION

The present invention relates to a physical interaction means and related uses thereof. In particular although not solely the present invention relates to a physical exercise and/or stretching means.

BACK GROUND OF THE INVENTION

A multitude of devices for exercising are available to the public. Such devices come in many formats and each one is designed to allow a user to exercise a specific group or several groups of muscles. However many such devices do not offer the user the facility to conduct pre-exercise stretching to reduce the likelihood of the incidence of muscle damage during exercise. While a person is able to conduct such stretching without the use of specialized equipment, by for example leaning against a wall to apply pressure to the calf muscles or other leg muscles to stretch such muscle groups, such unaided stretching may not allow the person to provide sufficient pressure to their muscle groups. Unaided stretching may also not allow a person to stretch particular muscle groups as a result of being unable to achieve certain physical positions. It is also known that in order to effectively stretch some muscle groups, people often pair up to provide assistance in stretching certain muscle groups. The person assisting can aid the person stretching by isolating parts of the body, supporting certain parts of the body or immobilizing certain parts of the body to allow the person stretching to achieve the desired stretching result. However a person who is wishing to stretch certain muscle groups of such a kind may not necessarily have another person available to them to aid in the stretching. Likewise for conducting certain exercises, it may be desirable to immobilize certain parts of the body so as to provide a stationary point of the body against which a force can be applied. Sit-ups are one example where it is desirable for the feet of the person to be immobilized. Press-ups are another example where both the hands and the feet are immobilized.

Some exercise machines such as exercycles and steppers, can isolate target muscles.

The disadvantage of using machines is that they do not offer much variety as one machine may only be used for one purpose. Another problem is that machines are often designed for the average person, and may be uncomfortable or impossible to use for a very tall or very short person or disabled persons.

Free weights such as dumbbells and barbells, on the other hand, allow the body to assume more 'natural' positions, allowing the simulating of real-life movements more accurately. It encourages a person to employ stabilizer muscles properly and to use correct body alignment. Free weights also offer much more variety and can be used in lots of different ways to target different muscle groups.

Free weight exercises are normally suitable for most exercisers, but often beginners need a lot of guidance to ensure they are using proper form and technique. People who do not have the necessary skills may develop serious injuries by training incorrectly.

People who have suffered from muscular sport injuries or who have disabilities, often visit a physiotherapist for manipulative treatment or therapy of the injury. Carrying out such treatment normally requires the aid of a person to manipulate the injury in order to access the muscles that need repair.

Without the assistance of a person aiding in the manipulation of the injury it becomes difficult for the injured person to carry out any stretching and/or exercises needed for remedial work.

In addition to stretching and exercising, a person may be in need of remedial skeletal alignment treatment. While specific apparatus do exist for providing such treatment, the inventor is not aware of any device which is of a simple form or which allows for both stretching and exercise as well as remedial skeletal alignment to be performed without the input or significant assistance of another person.

Accordingly it is an object of the present invention to provide a physical interaction means for exercising, stretching and/or remedial skeletal alignment which can be utilised by an individual without assistance of another person or to at least provide the public with a useful choice.

It is also an object of the present invention to provide a stretching apparatus which can be utilised by a person to stretch more muscle groups than by unassisted stretching or to at least provide the public with a useful choice.

It is also an object of the present invention to provide an exercising apparatus and its use that aids in overcoming some of the problems as mentioned above or at least to provide the public with a useful choice.

BRIEF SUMMARY OF THE INVENTION

Accordingly in a first aspect of the present invention consists in a physical interaction means for the purposes of allowing a person to perform physical training and stretching of muscles said physical interaction means comprising a wall including a wall surface of one of a hook component and loop component of a hook and loop fastening system, a floor which includes a floor surface of one of a hook component and loop component of a hook and loop fastening system and being one of a said hook component and loop component the same as that of the wall surface of said wall, wherein said floor surface is provided adjacent said wall surface such that a said person can be upwardly supported by said floor surface and simultaneously engage with the wall surface, a wearable item, wearable by a said person, said wearable item selected from one of a) at least one glove and at least one footwear, b) two gloves and c) two footwear, said wearable item having an outwardly presented surface consisting of the other one of the hook component and loop component of a hook and loop fastening system so as to allow its selective and releasable attachment by a said person wearing said wearable item to of each of said means defining a wall and floor surfaces.

Preferably two of said gloves are provided one for each hand of said person.

Preferably said footwear is a bootie and wherein two of said booties are provided one for each foot of said person.

Preferably said wall surface includes a planar region inclined to the vertical with the normal to said wall surface projecting above the horizontal.

Preferably said wall surface and said floor surface abut each other.

Preferably said floor surface is inclined to the horizontal with the normal to said floor surface having a component of direction projecting away from the said wall surface.

Preferably said wall is a wall unit comprising of wall panel with which said one of a hook component and loop component of a hook and loop fastening system is engaged, said wall panel engaged to a support structure to be supported as a unit by a permanent fixed structure.

Preferably said floor is a floor unit comprising of floor panel with which said one of a hook component and loop component of a hook and loop fastening system is engaged, said floor panel engaged to a support structure to be supported as a unit by a permanent fixed structure.

Preferably said wall surface extends from and above said floor surface, to a height of at least 1.5 meters.

Preferably said floor surface extends from said wall surface to a distance away there from of at least 1.0 meters.

In still a further aspect the present invention consists in a method of physical interaction by a person with two reaction surfaces for the purposes of their physical stretching/exercising said method including:

donning said person with two items selected from i) at least one glove and at least one footwear, ii) at least two gloves and iii) at least two footwear, and engaging said items with said reaction surfaces, said reaction surfaces having disposed thereon one of a hook component and loop component of a hook and loop fastening systems, the at least one of said glove and footwear presenting the other one of said hook component and loop component of a hook and loop fastening system such that said person can selectively engage and be resistant to release from said reaction surfaces in a plurality of locations and orientations, said at least one of said glove and footwear to thereby provide reaction to the forces applied by said person thereto, wherein a first reaction surface is a wall and a second reaction surface is a floor juxtaposed said wall.

Preferably said resistance to any forces applied resultant from the engagement between said at least one of said glove and footwear is in a direction parallel to said reaction surface where said at least one of said glove and footwear is engaged.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

The invention is now described by way of example, with reference to the accompanying drawings in which;

FIG. 1 is a side view of the fixed structure of the interaction means being a wall and floor reaction surface, FIG. 2 is a perspective view of FIG. 1.

DETAILED DESCRIPTION OF THE INVENTION

Figure 3:
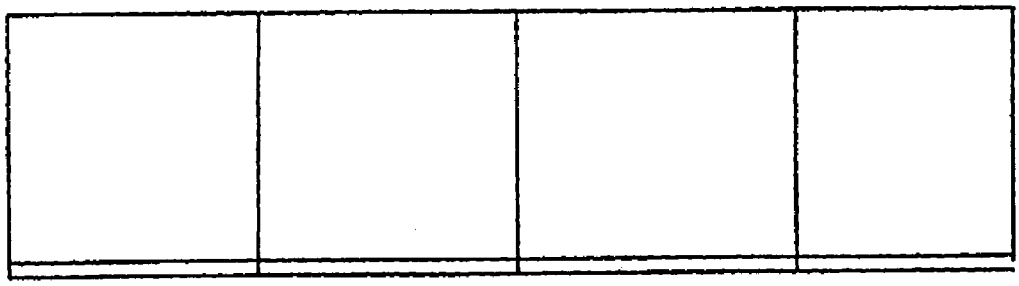
FIG. 3 is a front view of FIG. 1.
Figure 4:
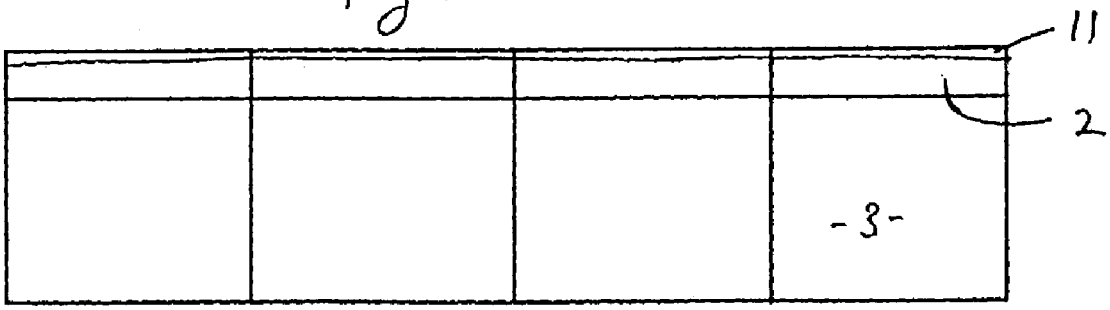
FIG. 4 is a plan view of FIG. 1.

The interaction means includes at least one reaction surface which is or is fixed or otherwise supported by or to a fixed structure of a building. With the use of gloves and/or booties worn by a user to apply action forces by his or her body to the surface they will be subjected to a reaction from the surfaces. In the most preferred form the reaction surfaces include both a wall surface 2 and a floor surface 3 positioned adjacent each other so that both can be engaged by a user simultaneously. The reaction surfaces are covered at least in part and preferably entirely by one component of a hook and loop fastening system. The other component of the hook and loop fastening system is carried by the gloves and booties to which reference will be made hereinafter. The floor surface is planar and preferably also the wall surface is planar, but may be of other shapes.

In the most preferred form the reaction surfaces are covered by the loop form of the hook and loop fastening system. The loop form is softer to the touch so that any contact of the skin of a person with the surfaces will not subject the person to any significant abrasion. It is well known that the loop component of a hook and loop fastening system is not as soft to the touch.

In the most preferred form the reaction surfaces are covered entirely by a component of the hook and loop fastening means and the area of coverage is sufficient so that a person can assume many different positions adjacent the surfaces would still remain in contact with the component on the surface.

For example the wall surface may be of a height of approximately 2.4 m above surrounding ground. This is of a sufficient height to allow the average person to stand adjacent the wall surface 2 and stretch upwardly without stretching beyond the upper boundary 11 of the wall surface 2. Most preferably the height is at least 1.5 m but being higher allows for more positions to be assumed. The width (in direction B) (with reference to FIG. 2) of the wall section 2 is also sufficient to allow for a diverse range of positions to be assumed by a user of the invention without stretching beyond the boundary.

For example, in a preferred form the wall is planar and of a width which is sufficient to allow for a person to stand adjacent the wall and to spread both arms outwardly without both finger tips of each hand extending beyond the boundary of the wall surface 2.

Width expansion of reaction surfaces is shown in FIG. 2 where there is shown four adjacent sections.

The width (in direction B) of the reaction surfaces may be sufficient so as to allow for a plurality of users to be standing on/adjacent the surfaces for their simultaneous use thereof.

Preferably the reaction surfaces are retrofit able to an existing structure of a building. For example the reaction surfaces may be part of a structure fabricated of sheets of ply wood to define a unit having a surface or surfaces onto which the loop component of the hook and loop fastening system is affixed (such as by adhesion). The fabricated ply wood structure can then be bolted or otherwise affixed to a fixed wall and/or floor structure of a building. It is important that the reaction surfaces remain securely fixed although it is envisaged that such affixing can be temporary in case the reaction surfaces are to be transportable. Adjacent unites may be secured together by fasteners such as bolts or screws. With an extensive coverage area of the loop component of the hook and loop fastening means onto the plywood surfaces, a diverse arrange of positions can be assumed by the user of the system.

With the provision of both a floor and wall surface, a person can receive support to all of the limbs by the reaction surfaces of the present invention.

Figure 10:
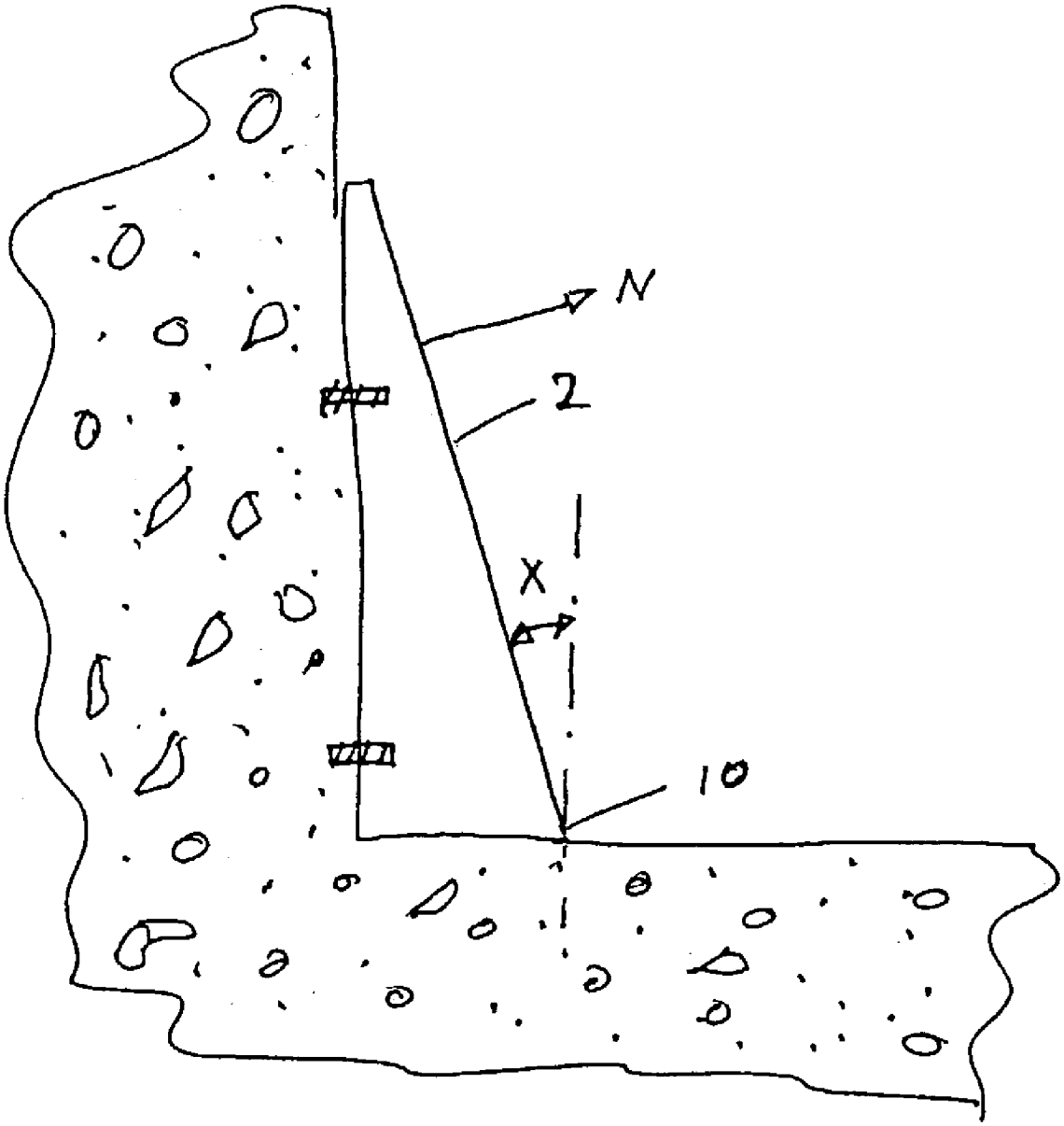
FIG. 10 is a sectional view through a permanent fixed building structure illustrating a means providing a wall reaction surface mounted there against.
Figure 12:
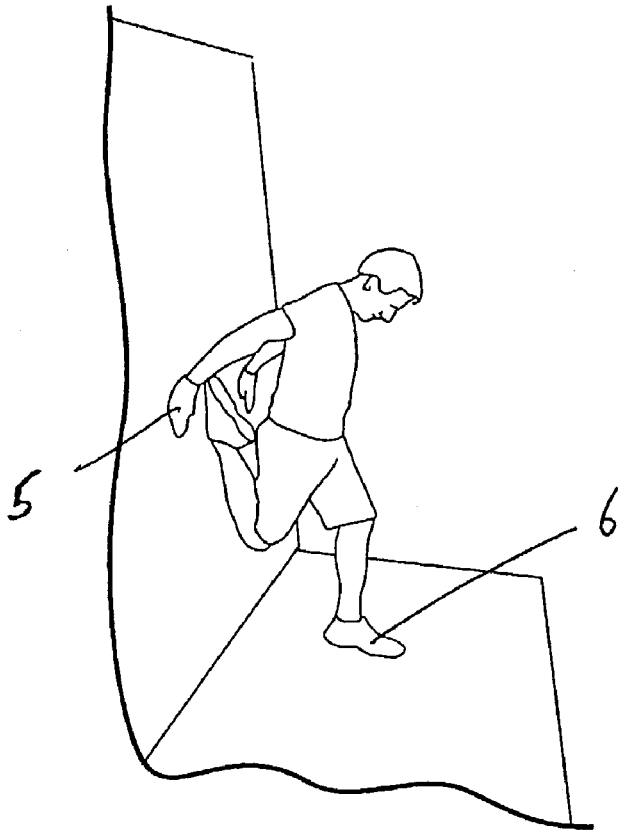
FIG. 12 illustrates a person using the interaction means for the purposes of applying pressure to the quadriceps.
Figure 11:
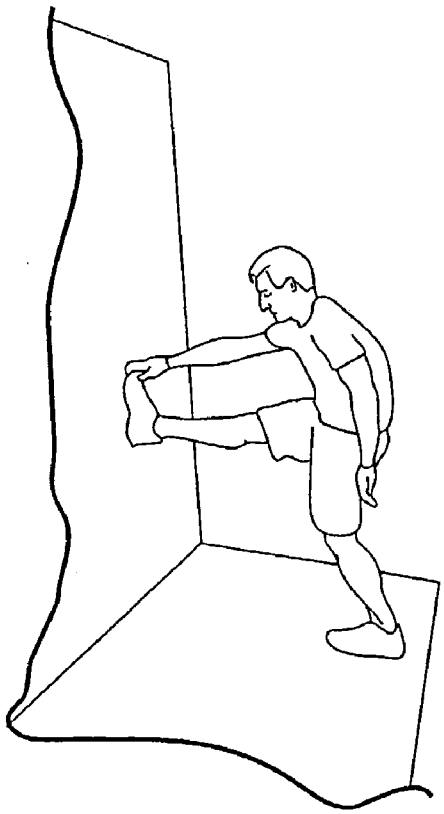
FIG. 11 illustrates a person using the interaction means for the purposes of applying pressure to the hamstrings.
Figure 14:
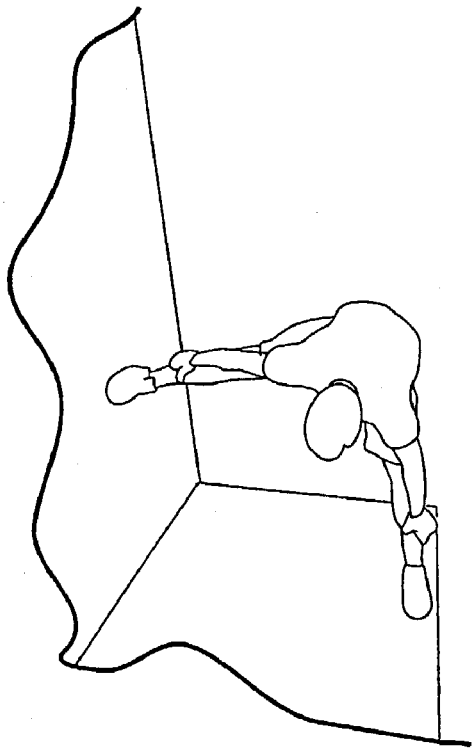
FIG. 14 illustrates a person using the interaction means for the purposes of applying pressure to the gluteals.
Figure 13:
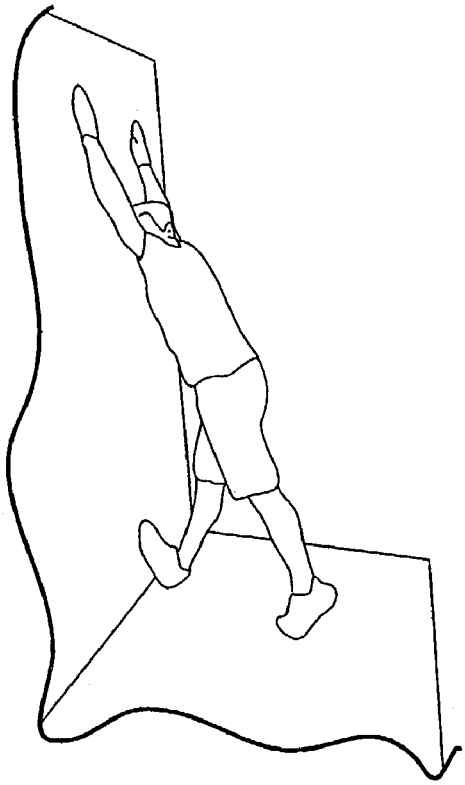
FIG. 13 illustrates a person using the interaction means for the purposes of applying pressure to the calf gastrocs, soleus and archilles tendon.
Figure 15:
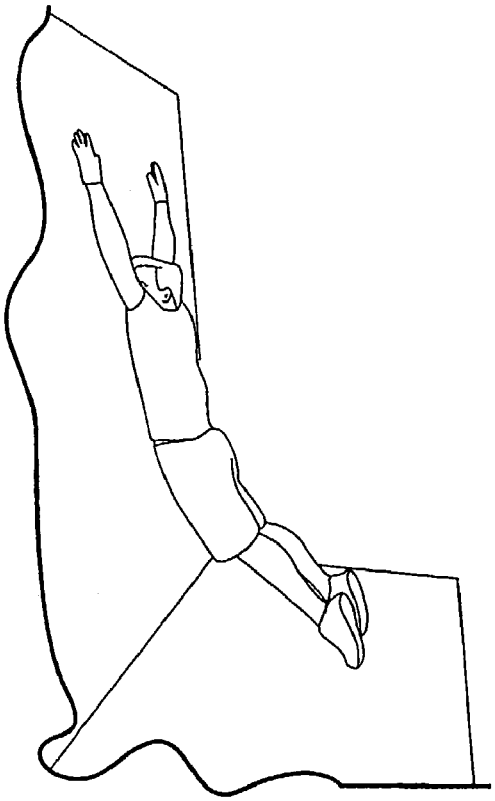
FIG. 15 illustrates a person using the interaction means for the purposes of applying pressure to the finger flexors, biceps, pictals, abdominus rectos, quadriceps and psoas.
Figure 16:
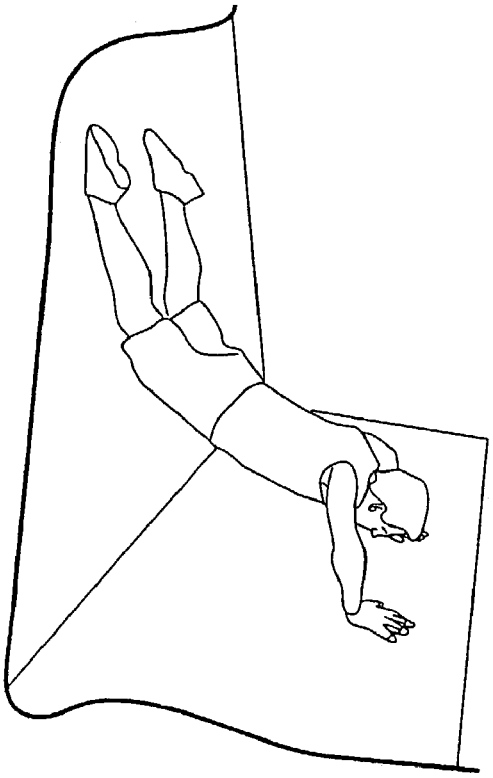
FIG. 16 illustrates a person using the interaction means for the purposes of applying pressure to the biceps.
Figure 18:
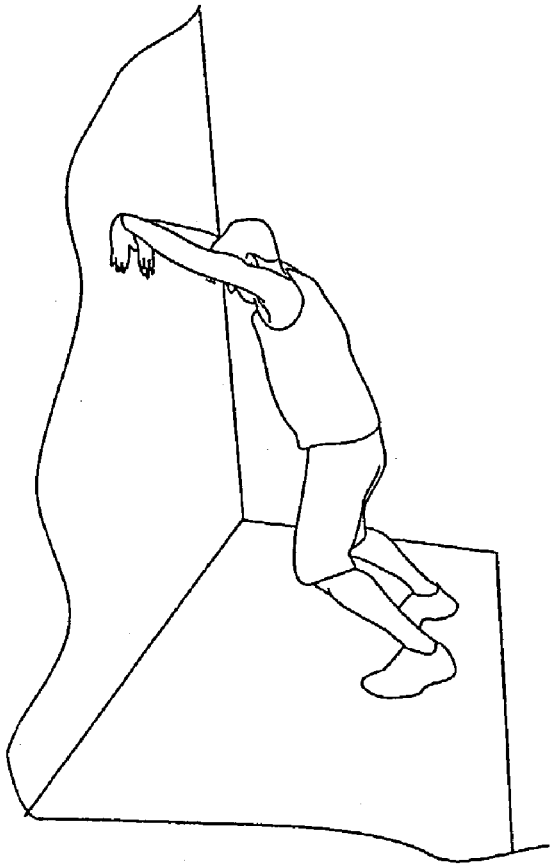
FIG. 18 illustrates a person using the interaction means for the purposes of applying pressure t the finger flexors.
Figure 17:
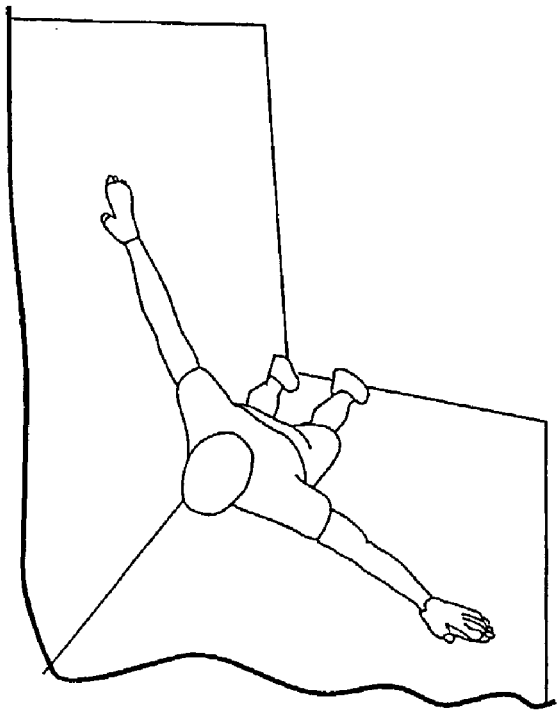
FIG. 17 illustrates a person using the interaction means for the purposes of applying pressure pectorals and finger flexors.
Figure 19:
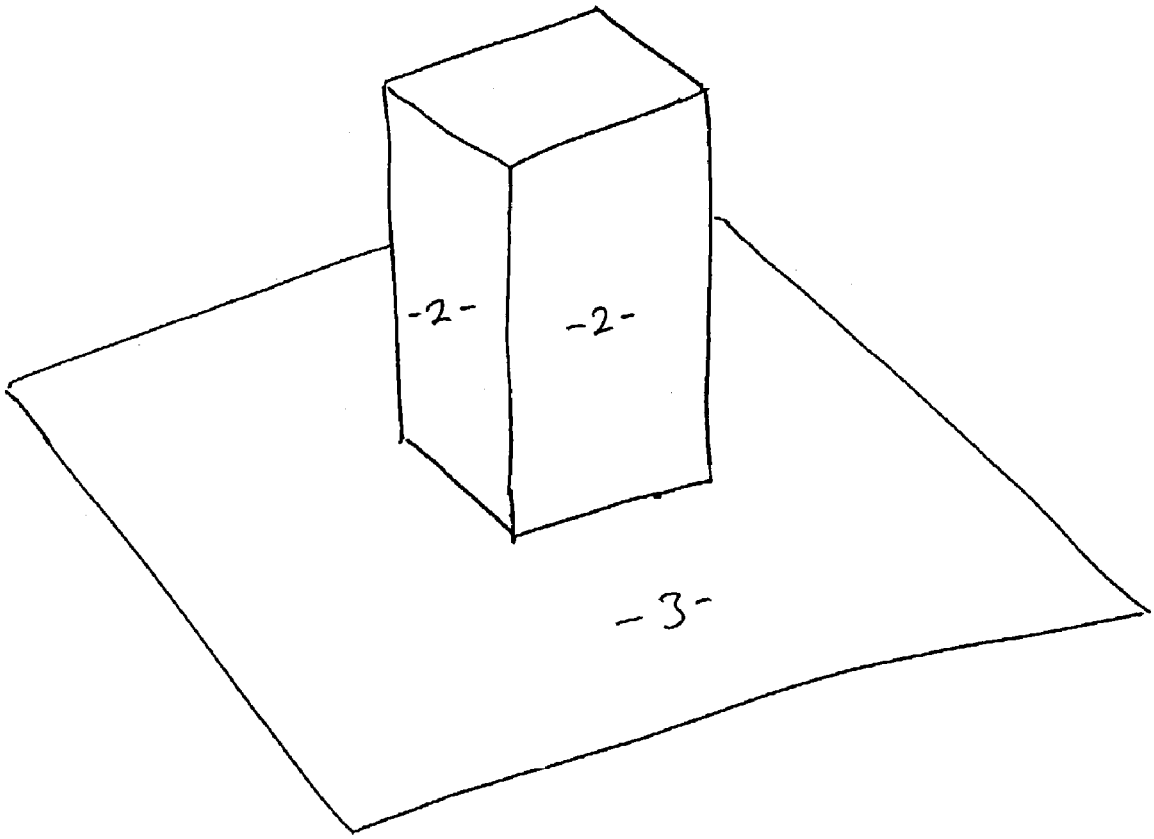
FIG. 19 illustrates an alternative arrangement wherein there are a plurality of reaction surfaces provided as a station about which a number of people can be positioned.

However it is envisaged that only a wall surface 2 (as for example shown in FIG. 10) is provided for the purposes of providing a reaction surface of the interaction means of the present invention. Such a wall extends to a sufficient height (e.g. greater than 1.5 m) from the adjacent ground on which a person may stand to allow for a person standing adjacent the wall to assume a diverse range of positions including the engagement of their hands and/or feet onto the wall surface 2. The fixed structure may be a wall or floor of a building.

However the combination of wall and floor surfaces provides for a much more versatile arrangement of reaction surfaces.

It is envisaged that the reaction surfaces may come in a collapsible form so that both the wall and floor surfaces are removable from each other to allow for convenient storage and transportation. Indeed each wall and floor surface unit may itself be collapsible into more portions. Each wall unit for example may be broken down into two or more components for the purposes of convenient storage and/or transportation. Likewise the floor surface unit may do the same. It is envisaged that the present invention may be utilised in home situations where the convenience of storage and assembly is an important factor.

Figure 5:
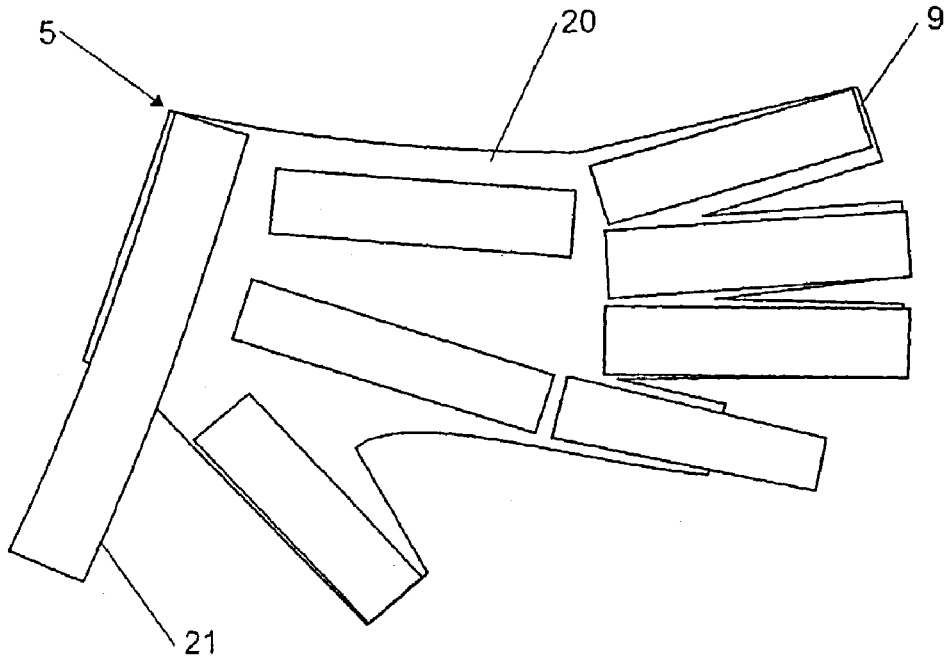
FIG. 5 is a top view of a left hand glove to be worn by a user for use with the reaction surfaces of FIG. 1.
Figure 6:
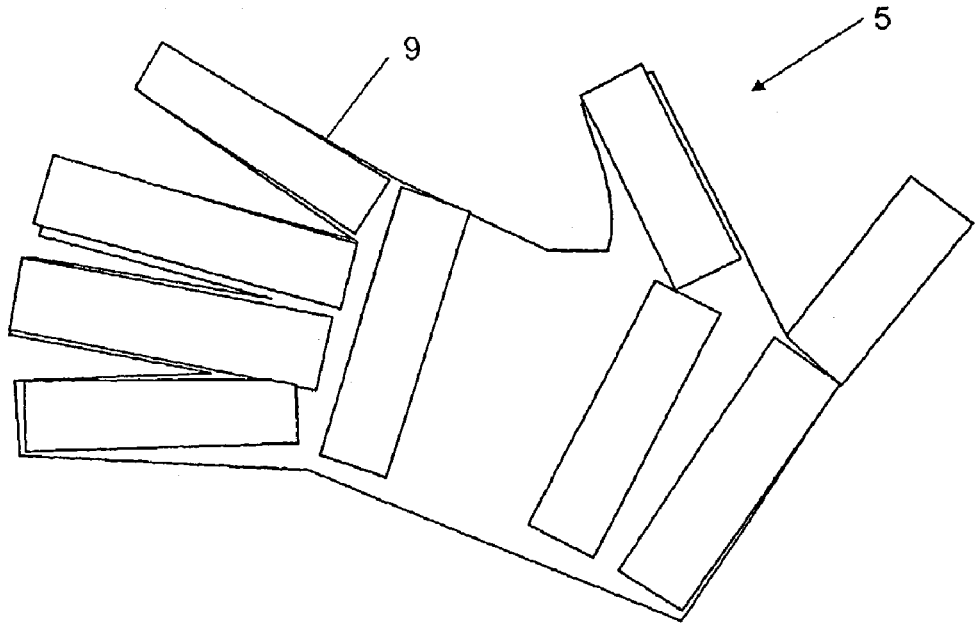
FIG. 6 is a bottom view of a right hand glove.

The interaction means incorporates outerwear articles to be worn by the user of the system. In the most preferred form the user will be wearing at least one glove and preferably also at least one bootie. Preferably a user will be wearing two gloves and two booties. A glove is for example shown in FIGS. 5 and 6. The glove may be of a fingerless or finger kind (and possibly but less preferably of a mitten kind) however its main purpose is to remain securely fixed to the hand of a person. With the provision of the other component of the hook and loop fastening system to the component provided on the reaction surfaces (2, 3) can allow for the glove to become affixed to the reaction surfaces. The glove may be entirely covered with the hook component or may be pattern applied. For example strips or panels 9 of the hook component may be sewn onto the body 20 of the glove in locations where the glove is likely to make contact with a reaction surface (whether floor or wall 3, 2). Such regions may include the fingers, and on the palm side of the hand as well as the like surfaces on the other side of the hand. The glove may include a wrist strap 21 for the purposes of tightening the glove about the wrist. It is important that a glove of a size appropriate for the size of a users hand is selected so that a tight fit is achieved. When a person is applying pressure to a reaction surface via the glove, it is important that the glove does not move significantly relative to the hand.

Figure 7:
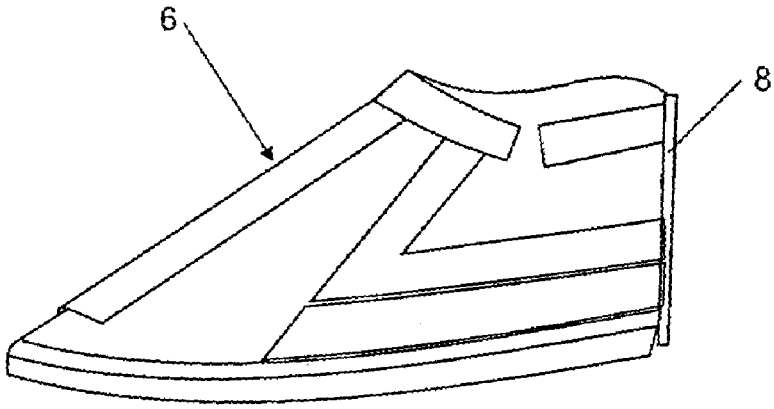
FIG. 7 is a perspective view of a bootie or shoe or the like footwear for use with the reaction surfaces of FIG. 1.
Figure 8:
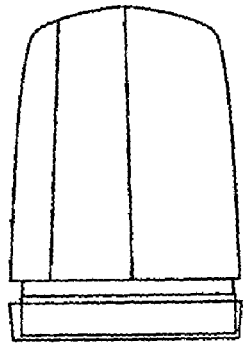
FIG. 8 is a back view of the bootie of FIG. 7.
Figure 9:
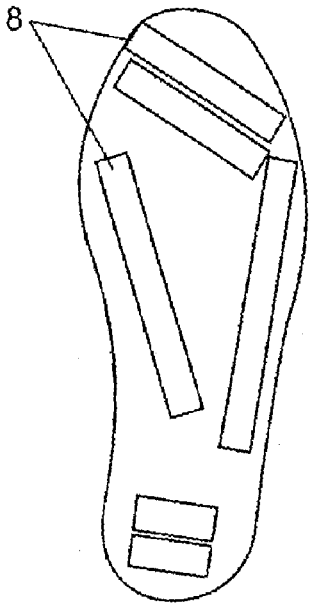
FIG. 9 is a bottom view of the bootie of FIG. 7.

With reference to FIG. 7-9, there is shown a bootie which can be worn by the user of the present invention. The bootie will engage onto the foot of a user and has disposed onto exterior surfaces thereof, regions of a component of a hook and loop fastening system. Again most preferably and since the reaction surfaces 2, 3 are provided with the loop component of the system, the booties are provided with the hook component of the hook and loop fastening system. The booties may include strips of the hook component on the soles but also on the upper surfaces of the bootie. Such strips or panels 8 will allow for the bootie to become fixed onto the reactions surfaces (whether it be the wall surface 2 or the floor surface 3).

Positions by a user of the invention can be assumed by both the hands and the feet so that these touch and become affixed to the wall surface 2 of the device. It may only be the wall surface which is provided as the reaction surface of the present invention. However to increase versatility a floor surface 3 is also provided. In such a case, the user may have their feet or a foot engaged onto the floor surface and the hands or hand engaged onto the wall surface or vice versa or various combinations.

In order to encourage the association of a person with the wall surface 2, the wall surface is preferably inclined to the vertical. The incline is such that the Normal (N) of the surface has an upward component of direction. The resultant angle X which the wall surface 2 makes to the vertical is greater than 0° and for example less than 30°. A person standing adjacent the wall surface with their feet at or proximate the wall surface base 10 will need to lean over centre to their general upright direction in order for the body to make contact with the surface 2. A person facing the wall hence needs to lean forward. A person with their back to the wall, will need to be leaning backwards in order to make contact with the surface. The angling of this wall surface 2 hence encourages both a psychological tendency to lean towards the wall as well as a physical tendency. Assuming that all other things are equal, a person engaged for example with their hands to the wall surface 2 is more likely to stay engaged and have a feeling of engagement or association with the wall, than were the wall to have a normal which was horizontal or had a downward component (i.e. an overhanging wall). It is hence desirable for the wall to have an angle to the vertical greater than 0° and where the normal of the surface has a component directed upwardly. It is also envisaged that the wall surface 2 may be utilised for suspending a person (such as for example a child) by engagement of the gloves to the wall surface. By having a wall sloping in a manner as described, the body of the person will be biased as a result of gravity towards the wall thereby giving the feeling of engagement. This would not be the case were the wall to be overhanging or a wall which is purely vertical.

Where the present invention also includes a reaction surface which is a floor surface 3, such a surface is preferably sloping to the horizontal. In the most preferred form the slope is downwardly from the intersecting point 4 between the wall surface 2 and the floor surface 3. The angle Y that the floor surface makes with the horizontal is preferably greater than 0° and for example less than 30°. While the floor surface 3 need not be of a slope relative to the horizontal, it is preferred since a person standing on the floor surface 3 will then need to adjust their stance in order to remain standing upright adjacent the wall 2. For example a person facing the wall surface 2 will need to lean forward when standing flat footed on the floor surface 3. In order to remain standing upright, such a leaning forward will additionally encourage a tendency for the person to lean or fall towards a wall surface 2 engendering a feeling of security. This will encourage the making of contact of a person with the wall surface 2. The wall and floor where a person is to simultaneously be able to touch the surface of both preferably have a normal to each surface lie in the same plane which a vertical plane.

The floor surface may likewise be provided as part of a unit and for example be fabricated from a ply wood material. When viewed from the side as shown in FIG. 1, both the wall surface and floor surface 2, 3 are provided as part of wall and floor units. The wall and floor units are preferably independent items which are able to be abutted together. It is envisaged that alternative configurations may be adopted by the wall and floor unit where such are not touching each other. For example the wall unit may be elevated above the floor unit and there may be provided a gap therebetween. There may hence not be an intersection point 4 between the wall and floor units. The floor surface extend preferably from the wall surface at least 1 m outwardly therefrom. Preferably this distance is between 1 m and 2.4 m.

Furthermore while in the most preferred form the wall surface 2 and preferably the floor surface 3 are substantially planar, such surfaces need not be entirely planar. Indeed the surfaces may include apertures therethrough, particularly the wall surface 2 may include apertures to provide further assistance for holding the hand or the feet of a person. The surface may also include upstands which are provided in places tailored to assist in allowing for certain positions to be assumed by a user.

The wall surface may alternatively be curved both vertically and horizontally. For example the wall surface may be-provided by a vertical pillar.

In the most preferred form the hook of the hook and loop fastening system that is used is a product called CS 1200™ Hook provided by 3M. This product of 3M provides a high shear strength between the two components of the system yet under tension, allows for a convenient removal. Table 1 shows the performance specs of this product as published by 3M on their current website.

TABLE 1

| Typical Product Characteristics | Closure Performance with 3M ™ Nonwoven Loop: | |
|---|---|---|
| 180° Hook to Loop Peel Force | 4.5 N/25 mm | 3M TM-3740 |
| Dynamic Shear Force | 60 N/25 × 25 mm | 3M TM-3749 |

As a result, the shear direction holding force between for example the gloves or the booties and the reaction surfaces 2, 3 is extremely high when compared to the tension force. Accordingly it is convenient for a person to pull their hands and feet off the surfaces by a force substantially normal to the surface however a sliding of the gloves and booties relative to the surface is highly resisted. Hence a person utilising the present invention can move about on the surface relatively conveniently without any significant strain being placed on the muscles of the user. However when a shear force is applied by the user, the gloves and/or booties will remain firmly in place. This hence reduces the possibility of injury. Action forces can hence be applied to the reaction surfaces in a shear direction. An original hook and loop fastening system commonly referred to as VELCRO™ may be used. Modern variations but which work in the same manner are to be considered as forming part of the invention. The loop component of the Velcro is applied as a panel to the backing panel of plywood or similar.

The present invention may be utilised for several different purposes. While the present invention has broadly been termed an interaction means or system using reaction surfaces for action forces to be applied by a person, the invention has applications in the stretching of muscles of a person, the exercise of muscles of a person and for the purposes of remedial skeletal alignment. The primary purpose of the present invention is to allow for a person to stretch their muscles prior to conducting or subsequent to conducting physical exercising.

With reference to FIG. 11-18 there are shown different positions that a person may assume in order to provide stretching forces to the muscles. Reference is made to the brief description of the drawings which briefly indicates the different muscle groups which may be stretched by the various positions shown in FIGS. 11–18. The reaction surface or surfaces of the present invention may also be engaged by a person wearing gloves and/or booties in a manner so that exercising can be performed. Many of the positions illustrated will also allow a person to conduct exercises It will be appreciated by a person skilled in exercise techniques that exercises such as sit ups, push ups and dips can be performed wherein for example the feet or the hands of a person can be conveniently held stationary relative to the reaction surface(s) for the purposes of conducting such exercises. A result of being able to place the hands and/or feet wearing the gloves and/or booties against the reaction surfaces, such can be held stationary in order to allow for a person to assume an appropriate position to conduct exercises and/or to isolate certain muscle groups for the purposes of conducting such exercises and/or stretching. This can be achieved without the aid of another person.

It is also envisaged by the inventor that the present invention may be utilised for the purposes of remedial skeletal alignment. By way of example, it is possible for a person to be wearing a glove on each hand and to place their hands above their head against the wall surface 2 and assume a position wherein they are effectively substantially suspended by the gloves downwardly and against the surface 2. A substantial part of the weight of the body can be transferred through the gloves onto the wall surface thereby allowing for the spine of a person to assume a naturally extended direction and encouraging the spine to assume a natural alignment. The therapist can then also manipulate the body are desired. It is accordingly envisaged that the present invention may be utilised not just by the physiotherapy profession but also by chiropractic and osteopathic profession for the treatment of patients.

With the use of the invention it is possible to provide "Isometric"/resistance exercise and resistance stretch plus minutely controlled "Concentric" and "Eccentric" load to muscle tissue throughout the range of motion of the muscle the body's own mass.

This provides for passive and active stretch and muscle workouts for the entire muscle length as the maximum load point may be readily adjusted by slightly moving bodymass unlike a machine and with the support of other muscles to reduce injury opportunity that is a risk in free weight training.

Additionally a major advantage is that the device can allow exercise and stretch without re-location of the user.

Isometric exercises are those in which a force is applied to a resistant object. An example is pushing against a brick wall—even though there is a build up of tension in the muscles, there is no actual movement. A few points about isometric exercises are as follows:

To increase strength, it is necessary to maintain a position in any one exercise for 6 to 8 seconds.

The exercise should be repeated 5 to 10 times.

Any one isometric exercise will only increase muscle strength at one joint angle. Strengthening the other joint positions requires repetition of further corresponding exercises.

Isometric exercises on their own are not recommended for strength training. They are only part of a complete exercise program.

As long as you are flexing or applying force against something, you are engaged in an isometric exercise. The great thing about isometric exercises is they can be performed just about anywhere and at any time, and with the use of the present invention it has now become possible for a person to assume many more body positions ad increase of adjust the level of force for the purposes of such exercises.

The present invention can be provided for use with little or no intrusion on space within a building. It can be conveniently mounted against a wall and onto a floor. It may be utilised in Gymnasiums as well as in office environments for stress relief purposes and aid in the recovery from OOS/RSI (occupational overuse syndrome and repetitive strain injuries) related conditions. Physiotherapy clinics may benefit from the present invention in that it may allow for an increased range of motions to be adopted by their patients.

With the isolation of the hands and feet, a person is able to work the tissue harder, then release/relax the tissue at higher rates. Since the invention is able to function as a stretching means and excising means it is possible to complete a workout routine then follow this with stretching without relocating or even adjusting positions.

With the provision of the Velcro in large areas to define the engagement walls and floors, another advantage of the present invention can be realised in terms of advertising. Brand names can be printed/created on the surfaces. The Velcro may for example be pattern cut an applied to the backing panels in a manner to present a brand name or logo.

As used herein "floor" should not be restricted to only structural floor and "wall" can include other upright supports (whether skeletal or panelled). As used herein "complementary attachment means" and use in conjunction with said means are preferably means to allow attachment to or from said floor or wall surface to enable an exerciser to manipulate the muscles or him or herself via releasable engagement.

I claim:

1. A physical interaction means for the purposes of allowing a person to perform physical training and stretching of the muscles, said physical interaction means comprising a wall including a wall surface of one of a hook component and loop component of a hook and loop fastening system, a floor which includes a floor surface of one of a hook component and loop component of the hook and loop fastening system and one of said hook component and loop component being the same as that of the wall surface of said wall, wherein said floor surface is provided adjacent said wall surface such that said person can be upwardly supported by said floor surface and simultaneously engage with the wall surface, a wearable item, wearable by said person, said wearable item being selected from one of a) at least one glove and at least one footwear, b) two gloves and c) two footwear, said wearable item having an outwardly presented surface consisting of the other one of the hook component and loop component of the hook and loop fastening system so as to allow its selective and releasable attachment by said person wearing said wearable item to each of said wall and floor surfaces.

2. The physical interaction means as claimed in claim 1 wherein two of said gloves are provided one for each hand of said person.

3. The physical interaction means as claimed in claim 1 wherein said footwear is a bootie and wherein two of said booties are provided one for each foot of said person.

4. The physical interaction means as claimed in claim 1 wherein said wall surface includes a planar region inclined from the vertical with the normal line to said wall surface projecting above the horizontal.

5. The physical interaction means as claimed in claim 1 wherein said a wall surface and said floor surface abut each other.

6. The physical interaction means as claimed in claim 1 wherein said floor surface is inclined from the horizontal with the normal line to said floor surface projecting away from the said wall surface.

7. The physical interaction means as claimed in claim 1 wherein said wall is a wall unit comprising of wall panel with which said one of a hook component and loop component of the hook and loop fastening system is engaged, said wall panel engaged to a support structure to be supported as a unit by a permanent fixed structure.

8. The physical interaction means as claimed in claim 1 wherein said floor is a floor unit comprising of floor panel with which said one of a hook component and loop component of the hook and loop fastening system is engaged, said floor panel engaged to a support structure to be supported as a unit by a permanent fixed structure.

9. The physical interaction means as claimed in claim 1 wherein said wall surface extends from and above said floor surface, to a height of at least 1.5 meters.

10. The physical interaction means as claimed in claim 1 wherein said floor surface extends from said wall surface to a distance away there from of at least 1.0 meters.

11. A method of physical interaction by a person with at least two reaction surfaces for the purposes of their physical stretching/exercising, said method including:

donning said person with at least two items selected from i) at least one glove and at least one footwear, ii) at least two gloves and iii) at least two footwear, and engaging said items with said reaction surface, said reaction surface having disposed thereon one of a hook component and loop component of a hook and loop fastening systems, the at least one of said glove and footwear presenting the other one of said hook component and loop component of the hook and loop fastening system such that said person can selectively engage and be resistant to release from said reaction surface in a plurality of locations and orientations, said at least one of said glove and footwear to thereby provide reaction to the forces the forces applied by said person thereto, wherein a first reaction surface is a wall and a second reaction surface is a floor juxtaposed said wall.

12. The method as claimed in claim 11 wherein resistance to any forces applied resultant from engagement between said at least one of said glove and footwear is in a direction parallel to said reaction surface where said at least one of said glove and footwear is engaged.

* * * * *